United States Patent [19]

Yamada et al.

[11] Patent Number: 4,974,033

[45] Date of Patent: Nov. 27, 1990

[54] TWO-SIDE IMAGE RECORDING APPARATUS

[75] Inventors: Takahisa Yamada, Sagamihara; Tadashi Nishio, Hino; Akira Yamamoto, Zama; Kazuo Noda, Tokyo, all of Japan

[73] Assignee: Olympus Optical Co., Ltd., Tokyo, Japan

[21] Appl. No.: 283,621

[22] Filed: Dec. 13, 1988

[30] Foreign Application Priority Data

Dec. 21, 1987 [JP] Japan ..... 62-321430
Dec. 21, 1987 [JP] Japan ..... 62-324258

[51] Int. Cl.[5] ..... G03G 21/00
[52] U.S. Cl. ..... 355/319; 355/200
[58] Field of Search ..... 355/319, 309, 318, 320

[56] References Cited

U.S. PATENT DOCUMENTS 4,403,851 9/1983 Yanagawa ..... 355/319 X
4,568,169 2/1986 Wada et al. ..... 355/319
4,607,948 8/1986 Naito ..... 355/319 X
4,650,313 3/1987 Koike ..... 355/319
4,692,020 9/1987 Tsujihara ..... 355/319
4,757,471 7/1988 Fukae et al. .
4,758,862 7/1988 Fukae et al. .
4,825,245 4/1989 Fukae et al. ..... 355/319 X
4,835,567 5/1989 Ogata ..... 355/318

*Primary Examiner*—A. T. Grimley
*Assistant Examiner*—William J. Royer
*Attorney, Agent, or Firm*—Frishauf, Holtz, Goodman & Woodward

[57] ABSTRACT

A cover is pivotally supported on the main body frame to close an opening formed on the side of the main body frame, and pivotally supports a sheet convey unit positioned between the cover and the main body frame. A sheet inserted into the main body frame is conveyed along a guide path defined between the main body frame and the convey unit to an image forming section so that one surface of the sheet is printed. Then, the sheet is turned and transferred along the path defined between the cover and the convey unit. The sheet is again conveyed to the image forming section so that the other surface of the sheet is printed.

15 Claims, 10 Drawing Sheets

TWO-SIDE IMAGE RECORDING APPARATUS

BACKGROUND OF THE INVENTION

1. Field of the Invention

The present invention relates to a two-side image recording apparatus in which a manual sheet feed means is constituted by a two-side image recording intermediate tray.

2. Description of the Related Art

In a conventional image recording apparatus such as a copying machine or a printer, images are recorded on both surfaces of a sheet as follows. A means for reversing a convey direction of the sheet (switch-back means) and an exclusive intermediate tray for temporarily storing the sheet are arranged in a sheet path so that the sheet having an image on one surface is temporarily stored on the intermediate try and, reversed and then transferred to a transfer unit where the other surface of the sheet is recorded.

In a conventional two-side image recording apparatus, since the sheet transporting path is complex, it is not easy to remove the jamming sheet also, since the exclusive intermediate tray is arranged as described above, a space for receiving the intermediate tray is required in the main body of the apparatus. The apparatus itself becomes bulky, and its mechanism is undesirably complicated.

SUMMARY OF THE INVENTION

It is an object of the present invention to provide a compact two-side image recording apparatus wherein any jamming sheet may be easily removed and a manual sheet feed means also serves as an intermediate tray for two-side image recording to eliminate the space required for the exclusive intermediate tray.

With the above arrangement, the manual sheet feed means can also serve as an intermediate tray for two-side recording. After an image is recorded on one surface of a sheet, the sheet is fed from the manual sheet feed means and is temporarily held thereby. Subsequently, the convey direction of the sheet is reversed by a convey direction reversing function of the manual sheet feed means and is fed to the image forming means again. An image is then formed on the other surface of the sheet. Therefore, the exclusive two-side recording intermediate tray can be eliminated, and the space therefor can be omitted. Therefore, the arrangement of the apparatus can be simplified, and a compact apparatus can be provided.

BRIEF DESCRIPTION OF THE DRAWINGS

FIGS. 8 to 11 are views showing a sheet convey unit, in which FIG. 8 shows an open state when the sheet convey unit is viewed from one side thereof, FIG. 9 is a partial sectional view showing a closed state of the sheet convey unit, FIG. 10 shows a closed state when the sheet convey unit is viewed from the other side thereof, and FIG. 11 shows a closed state corresponding to that of FIG. 8 when the sheet convey unit is viewed from one side thereof; and FIGS. 12 to 14 show a relationship between a vacuum duct and an intermediate duct for connecting the vacuum duct to a vacuum pump, in which FIG. 12 is a perspective view showing an overall structure, FIG. 13 is a perspective view showing the intermediate duct, and FIG. 14 is a perspective view showing the intermediate duct.

DETAILED DESCRIPTION OF THE PREFERRED EMBODIMENTS

Figure 1:
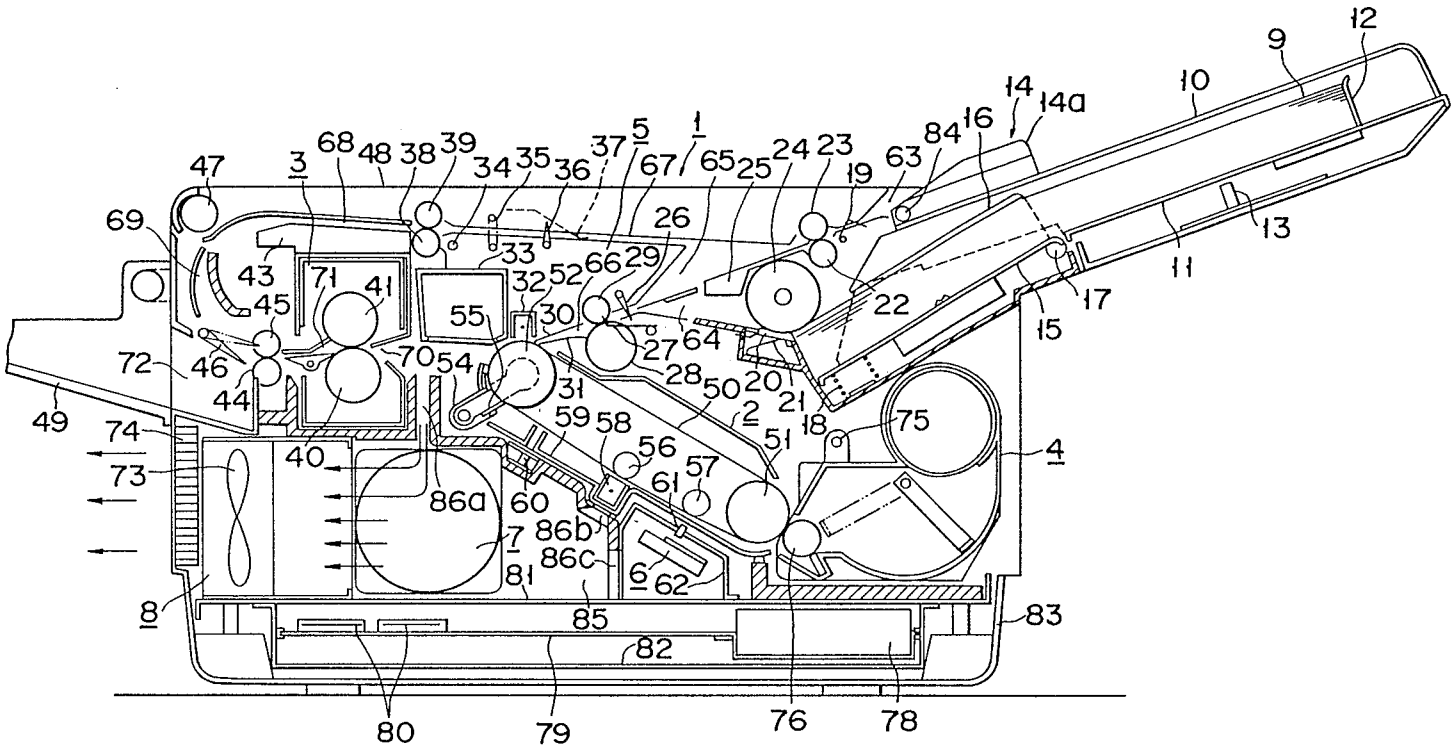
FIG. 1 is a front sectional view of a two-side image recording apparatus according to an embodiment of the present invention.
Figure 2:
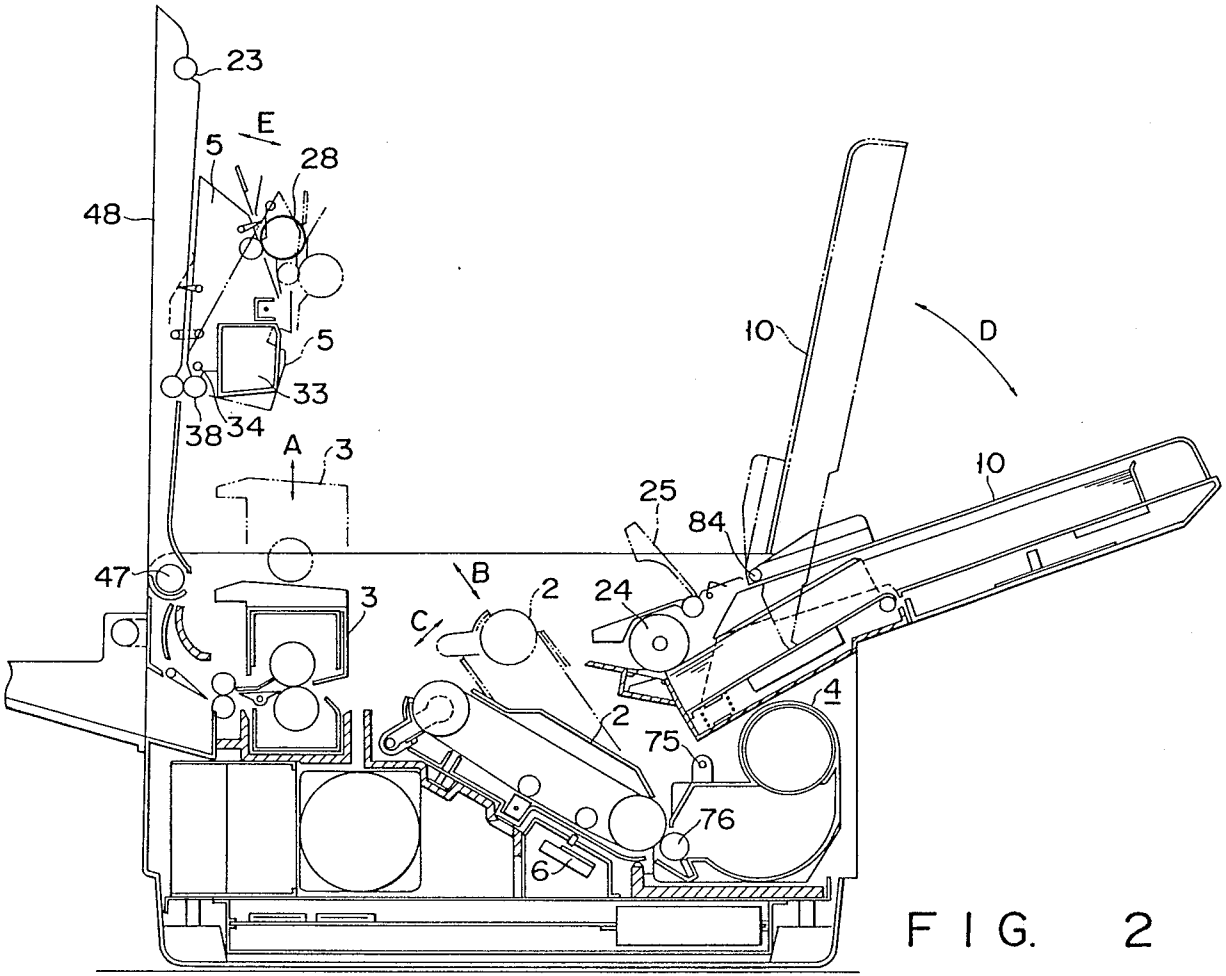
FIG. 2 is a view showing a state of the apparatus of FIG. 1 in which an upper surface cover is open.

A preferred embodiment of the present invention will be described in detail below. FIG. 2 is a sectional view of an image forming apparatus according to an embodiment of the present invention when viewed from its front side. Hatched portions are portions for connecting front and rear frames. FIG. 2 shows a state of the image forming apparatus when upper surface cover 48 is open. Referring to FIGS. 1 and 2, reference numeral 1 denotes a main body frame of the image forming apparatus; 2, a belt unit constituting an image carrier or the like; 3, a fixing roller unit; 4, a developing unit for developing a latent image; 5, a sheet convey unit; 6, a printing head for forming a latent image; 7, a motor; and 8, a power source unit.

One end of upper surface cover 48 is pivotally supported by shaft 47 in main body frame 1. Upper surface cover 48 can be pivoted about shaft 47 through 90° and can be opened, as shown in FIG. 2. Sheet convey unit 5 is loosely fitted on and supported by pivot point 34 and is held by spring 35 inside upper surface cover 48. Sheet convey unit 5 is pivoted together with upper surface cover 48 and can be opened. Pinch roller 23 opposite to manual feed roller 22 constituting part of manual sheet feed unit 14 serving as an intermediate tray having a sheet convey direction reversing function is pivotally arranged at the distal end portion of the inner surface of upper surface cover 48. Pinch roller 23 is pivoted together with upper surface cover 48 upward so as to be separated from roller 22.

Fixing roller unit 3 is detachable from a connecting portion of main unit frame 1 in a direction of arrow A in FIG. 2. Belt unit 2 is inserted in the main body unit in a direction of arrow B and rotated in a direction of arrow C, thereby mounting belt unit 2 in the main body frame. Belt unit 2 can be detached from the image forming apparatus by reverse procedures of the above operations. Developing unit 4 is swingably supported by pivot point 75 in the main body frame. Roller 76 of developing unit 4 is biased toward belt unit 2. Printing head 6 is fixed on frame 1 so as to oppose belt unit 2 below belt unit 2.

The main body frame comprises of a single molded body and is fixed on base 81 made of an iron plate. Shield case 82 as a conductive box is welded to base 81. Base 81 is fixed to plastic bottom cover 83.

Sheet separation plate 20 biased toward sheet feed roller 24 by spring 21 is urged against roller 24 rotatably supported by the frame. The rear end of intermediate plate 15 is supported by shaft 17, and plate 15 is swingable about shaft 17. Intermediate plate 15 is biased toward paper feed roller 24 by spring 18 mounted at the lower surface of the distal end of intermediate plate 15. Tray 11 is fixed to the frame, and the rear portion of sheet 9 is placed on tray 11. The side edges of the leading end portion of sheet 9 are guided by side guides 16 arranged on both sides of intermediate plate 15. The trailing end portion of sheet 9 is positioned by trailing end regulating plate 12 which is slidable on tray 11. The leading end of sheet 9 is urged against paper feed roller 24 through intermediate plate 15 by a biasing force of spring 18. The position of trailing end regulating plate 12 is detected by sheet size sensor 13.

Moistureproof cover 10 surrounds sheet 9 together with tray 11 to open/close tray 11 about shaft 84 arranged in the frame in a direction of arrow D in FIG. 2. Manual sheet feed guide 14*a* for positioning a widthwise direction of sheet 9 is arranged at the distal end portion of moistureproof cover 10.

Manual feed roller 22 and pinch roller 23 are arranged above paper feed roller 24. Manual feed roller 22 is rotatably supported by the frame, while pinch roller 23 is supported on upper surface cover 48. In a state wherein upper surface cover 48 is kept closed, pinch roller 23 abuts against manual feed roller 22.

Manual feed sensor 19 is arranged in a manual feed insertion sheet path between manual feed roller 22 and manual feed guide 14*a*. The presence/absence of the sheet can be detected when sheet 9 urges sensor 19. Manual sheet feed path 65 formed by guide 25 and the like and path 64 of sheet 9 fed from tray 11 by paper feed roller 24 are vertically separated and merge near convey roller 28 and its pinch roller 29 which are located in the downstream side of the above paths. Registration sensor 26 is arranged at the merging point. The sheet is detected when the sheet urges registration sensor 26.

Gate plate 27, one end of which is pivotally supported by the main body frame, is arranged at a position nearer to the sheet feed side than a nip portion of convey roller 28. Gate plate 27 can extend to block the sheet path or can be removed therefrom. Sheet path 66 is formed by upper and lower sheet guides 30 and 31 in the downstream side of convey roller 28. Corona transfer unit 32 is arranged to oppose the uppermost portion of image carrier belt 50 of belt unit 2 at a position nearer to fixing unit 3 than to sheet path 66. Vacuum dust 33 having a slit in the lower surface is arranged on the side of fixing unit 3. Convey roller 28, pinch roller 29, registration sensor 26, gate plate 27, corona transfer unit 32, and vacuum duct 33 constitute sheet convey unit 5. The corona transfer unit 32 cooperates with the image recording means to aid in forming the image onto a sheet, and is thus referred to in the claims as a cooperating means.

Belt unit 2 comprises a driving system, blade cleaning mechanism 54, and scorotron charger 58. This driving system comprises image carrier belt 50, driving roller 51, tension roller 52, corona shaft 56 serving as a backup roller, and head shaft 57. Image carrier belt 50 is looped around driving roller 51 and tension roller 52 and is driven by driving roller 51. Blade cleaning mechanism 54 includes cleaning blade 55 and an auger. Belt unit 2 is covered by SELFOC lens array 61 supported by frame 62 of printing head 6, sleeve 76 of developing unit 4, unit frame 53 having openings respectively corresponding to corona transfer unit 32 and discharge lamp 60, and cover 59 to constitute a single cartridge structure. When upper surface cover 48 at the upper portion of the main body frame is opened, belt unit 2 as a cartridge unit can be manually detached from frame 1 or replaced with another, as described above.

Fixing unit 3 comprises lower heat roller 40 for generating heat, and upper pressure roller 41 strongly urged against heat roller 40. Sheet path 70 is formed in fixing unit 3 on the side of belt unit 2 with respect to the nip of fixing unit 3, and sheet path 71 is formed on the side of exhaust roller 44. Exhaust roller 44 and pinch roller 45 are rotatably supported by the frame, and pinch roller 45 is in tight contact with exhaust roller 44. Gate 46 located in the downstream side of exhaust roller 44 is supported by the frame and can be pivoted between two positions. In the position indicated by the solid line in FIG. 1, gate 46 guides the sheet from rollers 44 and 45 to reverse sheet path 69. In the position indicated by the alternate long and two short dashed line in FIG. 3, gate 46 changes the feed direction of the sheet toward exhaust sheet path 72. Exhaust sheet path 72 extends outside the main body frame and is terminated at exhaust tray 49 for storing sheets thereon.

Reverse sheet path 69 is U-turned and connected to sheet path 68 formed between upper surface cover 48 and plastic sheet guide 43 fixed at the uppermost portion of fixing unit 3. Convey roller 38 rotatably supported by upper surface cover 48 and pinch roller 39 which is in tight contact with convey roller 38 are arranged on a line extended from sheet path 68. Sheet path 67 constituted by upper surface cover 48 and the frame of sheet convey unit 5 continues in a right downward direction of sheet path 68. Sensor 36 is arranged in sheet path 67. The presence/absence of the sheet is detected when the sheet urges sensor 36. Sheet path 67 merges into manual feed downstream path 65. Reference numeral 37 denotes a leaf spring for holding sheet path 67 at a predetermined height. The proximal end of leaf spring 37 is fixed to upper surface cover 48, and the distal end, i.e., the free end abuts against the frame of sheet convey unit 5.

Figure 3:
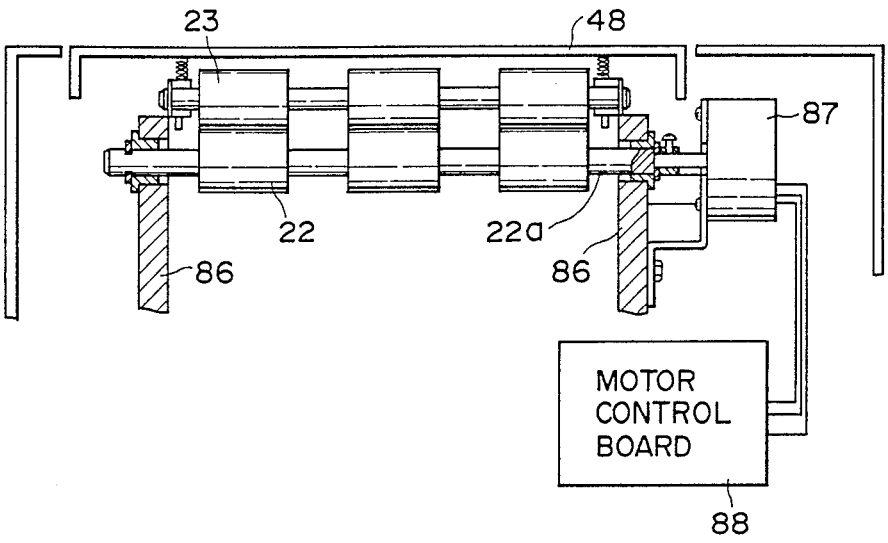
FIG. 3 is a view showing a manual feed roller portion.

In manual sheet feed unit 14 having a sheet convey direction reversing function and also serving as an intermediate tray, as shown in FIG. 3, manual feed rollers 22 are rotatably supported by roller shaft 22*a* on frame 86 of the main body frame through bearings. An output shaft of pulse motor 87 is fixed to manual feed roller shaft 22*a* so as to be coaxial with rollers 22. Motor 87 is driven and controlled in response to a signal from motor control board 88, so that rotation of rollers 22 is controlled.

Figure 4:
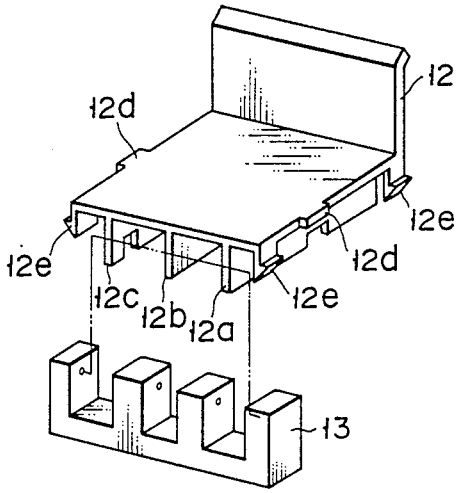
FIG. 4 is a perspective view showing a trailing end regulating plate.
Figure 5:
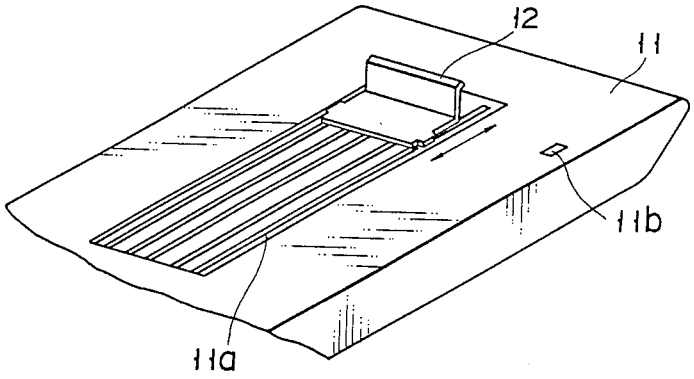
FIG. 5 is a perspective view showing a tray.

Sheet trailing end regulating plate 12 located on the upper surface of tray 11 is made of a single synthetic resin member. As shown in FIG. 4, three ribs 12*a*, 12*b*, and 12*c*, and engaging portions 12*d* and 12*e* are formed in trailing end regulating plate 12. Ribs 12*a*, 12*b*, and 12*c* are formed on the lower flat surface of plate 12, extended in a longitudinal direction and spaced apart from each other by predetermined intervals. Engaging portions 12*d* horizontally extend from both sides of plate 12, and engaging portions 12*e* extend downward from the both sides thereof. Ribs 12*a*, 12*b*, tray 11 and tray 11 is elastically held by engaging portions 12*d* and 12*e* from the upper and lower directions. The upper surface of tray 11 can be slid on the upper surface of tray 11 in directions of a double-headed arrow in FIG. 5 in accordance with the length of a sheet, and tray 11 can be locked at a predetermined position. Ribs 12*a*, 12*b*, and 12*c* extending from the lower surface of tray 11 through elongated holes 11*a* formed in tray 11 correspond to sheet size sensor 13 arranged on the lower surface of tray 11. Notches are formed in the lower surfaces of ribs 12*a*, 12*b*, and 12*c* at positions having different extension directions (positions which respectively correspond to lengths of B5, A4, and B4 sizes). When trailing end regulating plate 12 is moved and set to correspond to the sheet size, optical paths between three pairs of light-emitting and light-receiving elements arranged in upright portions of sensor 13 are selectively shielded by ribs 12*a*, 12*b*, and 12*c*. Therefore, a sheet size can be detected by an output pattern from the selected light-receiving element of sheet size sensor 13. A printing position, a sheet feed timing, a sheet jamming detection timing, and the like are properly changed in accordance with the detection signal.

Figure 6:
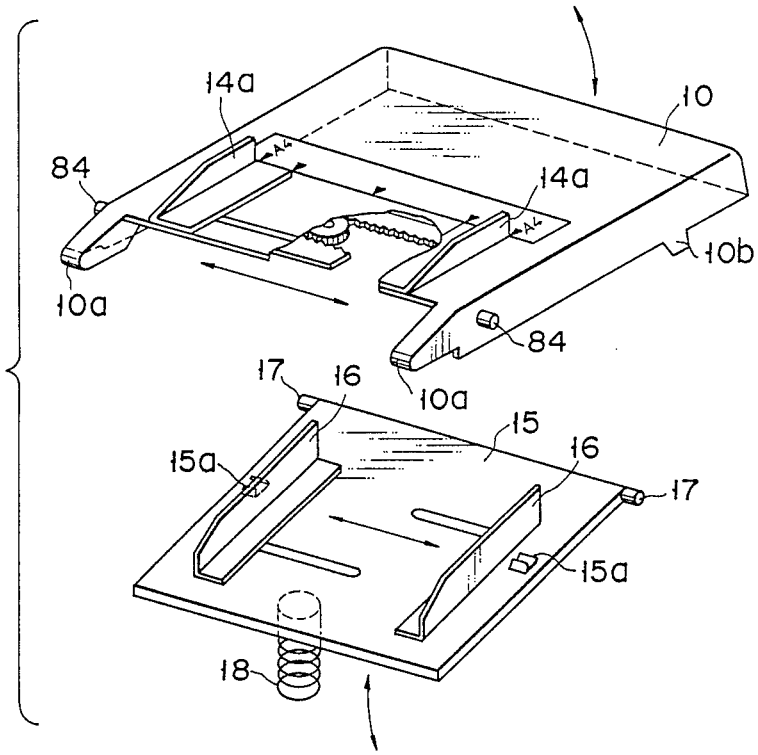
FIG. 6 is a perspective view showing a moistureproof cover and a middle plate.

Moistureproof cover 10 is pivotal about shaft 84 which is supported by both sides of the front end portion of cover 10 and which is fitted in holes of frame 86. A pair of manual feed guides 14*a* are formed on the upper surface of moistureproof cover 10 at a predetermined interval. As shown in FIG. 6, manual feed guides 14*a* can be slid on cover 10 by a rack-and-pinion mechanism constructed by a rack fixed on each manual feed guide 14*a* and a pinion rotatably mounted on cover 10, so that the width between guides 14*a* can be adjusted to correspond to the sheet width, thereby constituting manual sheet feed unit/intermediate tray 14.

Figure 7:
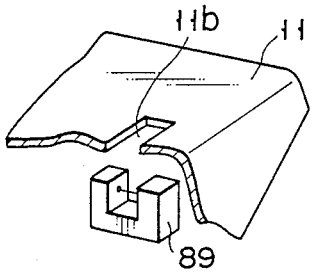
FIG. 7 is a partially cutaway perspective view showing a moistureproof cover sensor portion.

As shown in FIG. 6, in middle plate 15, both ends of shaft 17 extending from both sides of the rear end of plate 15 are fitted in holes of frame 86, respectively, so that middle plate 15 can be swung about shaft 17. Middle plate 15 is biased toward sheet feed roller 24 by spring 18 located to abut against the lower surface of the front end of plate 15. Moistureproof cover 10 is located above tray 11. When the rear end of cover 10 is moved upward and pivoted, projections 10*a* respectively formed at positions outside plates 16 near shaft 84 abut against middle plate 15 to move middle plate 15 downward against a biasing force of spring 18. Projections 10*a* are then engaged with engaging portions 15*a* formed at both sides of middle plate 15, respectively, so that moistureproof cover 10 is kept open. Projections 10*b* are formed on the lower end faces of both sides of moistureproof cover 10. When cover 10 is closed, projections 10*b* are inserted into holes 11*b* formed in tray 11. As shown in FIG. 7, an optical path of moistureproof cover sensor (consisting of light-emitting and light-receiving elements) 89 located below each hole 11*b* is shielded by the corresponding projection. Therefore, opening/closing of cover 10 can be detected.

Motor 7 is arranged in chamber 85 surrounded by power source unit 8, main body frame 1, and base 81. Holes 86*a*, 86*b*, and 86*c* are formed in a connecting portion of the frame which surrounds chamber 85. Fan 73 is incorporated in power source unit 8 near the central portion of the frame. Air is drawn from chamber 85 and is exhausted outside the apparatus through ozone filter 74. Referring to FIG. 1, reference numeral 78 denotes a floppy disk drive; 79, a control board; and 80, a memory card connector.

Sheet convey unit 5 and members associated therewith will be described with reference to FIGS. 8 to 11.

Figure 8:
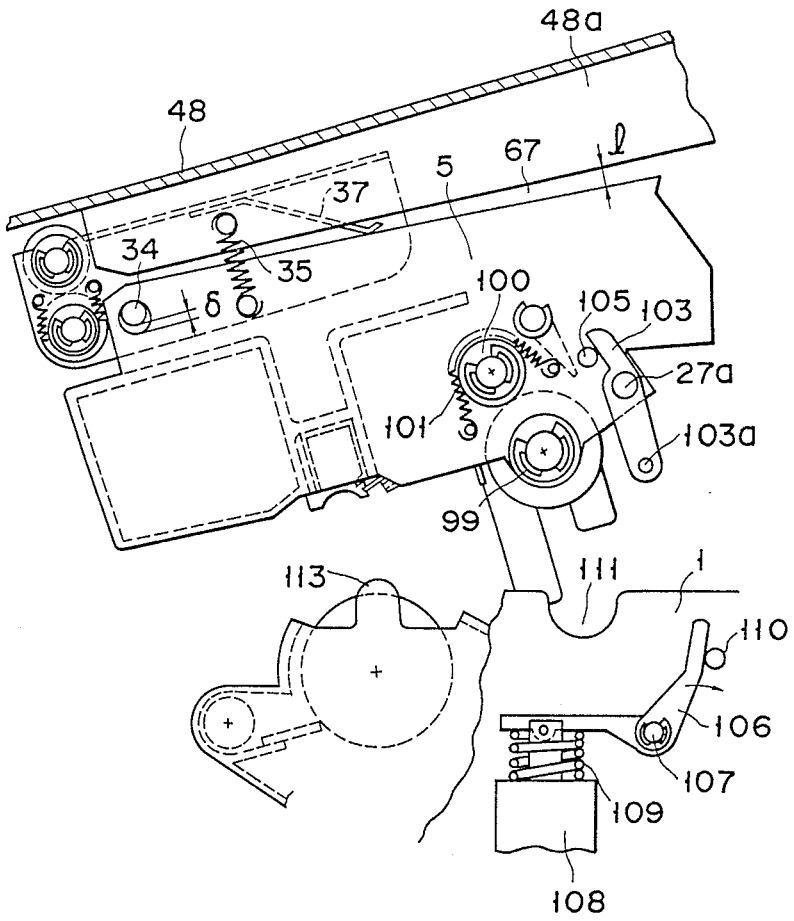
Figure 10:
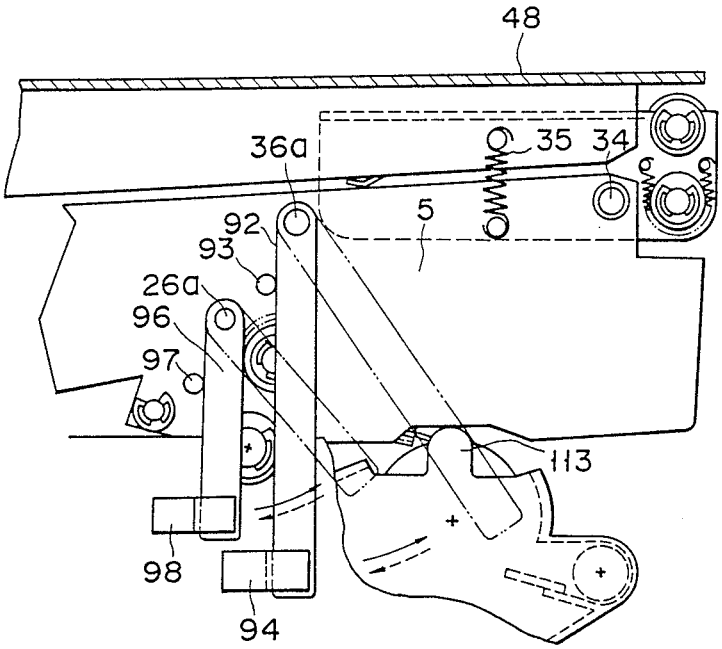

As shown in FIG. 8, when pivot shaft 34 mounted in cover plate 48 is loosely fitted in a through hole with a predetermined clearance δ, sheet convey unit 5 is pivotally supported by cover plate 48. Sheet convey unit 5 is biased toward cover plate 48 by coil spring 35 ends of which are hooked by sheet convey unit 5 and cover plate 48. When the other end of leaf spring 37, one end of which is fixed to cover plate 48, abuts against sheet convey unit 5, sheet convey unit 5 is biased to be spaced apart by a margin l from sheet guide 48*a* constituted by a rib of cover plate 48. Instead of using of coil spring 35, a pin may be projected on cover plate 48 and freely inserted in a slot formed in sheet convey unit 5. A biasing force of leaf spring 37 is set to be larger than that of coil spring 35. Sheet path 67 having a height l is formed between sheet convey unit 5 and cover plate 48. The proximal end of sensor 36 for detecting a sheet conveyed along sheet path 67 is fixed to one end of shaft 36*a* pivotally supported by sheet convey unit 5 and extending in the widthwise direction of the unit. The distal end of sensor 36 extends into path 67. The upper end of arm 92 is fixed to the other end (i.e., end opposite to sheet convey unit 5) of shaft 36*a*, as shown in FIG. 10. Upon rotation of shaft 36*a*, arm 92 is pivoted in a direction of an arrow in FIG. 10. Pivotal movement of arm 92 in one direction is limited by pin 93 extending from sheet convey unit 5 upon abutment of arm 92 against pin 93.

Photointerrupter 94 is arranged on main body frame at a position of arm 92 in a state wherein sensor 36 does not detect the sheet. Photointerrupter 94 comprises light-emitting and light-receiving elements which are spaced apart from each other by a predetermined distance. When the lower portion of arm 92 is located between the light-emitting and light-receiving elements at a position shown in FIG. 10, light from the light-emitting element is shielded by the lower portion and cannot be detected by the light-receiving element.

Figure 9:
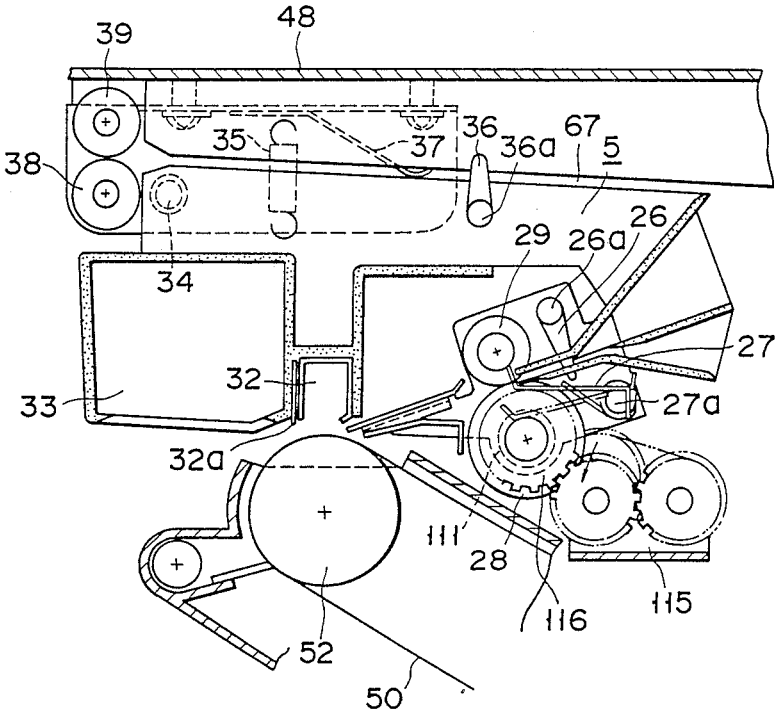

Registration sensor 26 is arranged at a merging portion of sheet path 64 and 65 (FIG. 1). The proximal end of registration sensor 26 is fixed to one end of shaft 26*a* pivotally supported by sheet convey unit 5 and extending in the widthwise direction of the unit, as shown in FIG. 9. The upper end of arm 96 is fixed to the other end of shaft 26*a*, as shown in FIG. 10. As a result, arm 96 is pivoted through shaft 26*a* in the same direction as that of registration sensor 26 upon pivotal movement of registration sensor 26. The distal end of registration sensor 26 extends into the merging path. When a sheet passes through the merging path, registration sensor 26 is pivoted by the sheet. Pivotal movement of arm 96 is limited when arm 96 abuts against pin 97 extending on the side plate of sheet convey unit 5. Photointerrupter 98 similar to photointerrupter 94 is arranged in the lower portion of arm 96. Upon pivotal movement of arm 96, a signal is generated.

Convey roller 28 extends outside sheet convey unit 5 and is rotatably supported by bearing 99 shown in FIG. 8. Similarly, pinch roller 29 is rotatably supported by bearing 100 mounted on sheet convey unit 5. Bearing 100 is movably mounted on sheet convey unit 5. Both ends of bearing 100 are biased in a convey roller direction by coil spring 101 fixed on sheet convey unit 5. As a result, pinch roller 29 abuts against convey roller 28. Gate plate 27 disposed in front of rollers 28 and 29 is supported by shaft 27*a* pivotally mounted on sheet convey unit 5 so as to extend into or retract from the sheet path. A substantially central portion of arm 103 is fixed to one end of shaft 27*a*, as shown in FIG. 8. Gate plate 27 is biased by spring 104 in a direction so as to be retracted from the sheet path. At a retracted position, one end portion of gate plate 27 abuts against stopper pin 105, and gate plate 27 is kept at the retracted position. Pin 107 horizontally extends from the other end portion of arm 103. L-shaped operation element 106 is pivotally supported by pin 107 near the upper surface of main body frame 1. When cover plate 48 is kept in a closed position, one end of operation element 106 is engaged with pin 103*a* of arm 103. The distal end of an actuation rod of electromagnetic solenoid 108 is supported by the other end portion of operation element 106. Compression spring 109 is arranged between the main body of solenoid 108 and operation element 106. Operation element 106 is always biased by spring 109 clockwise (in a direction of an arrow) in FIG. 8. Clockwise movement of operation element 106 is stopped at a predetermined position when one end portion of operation element 106 abuts against pin 110 extending on main body frame 1. Bearing groove 111 which defines a closed position of cover plate 48 is formed in the upper portion of main body frame 1 when bearing 66 is fitted in bearing groove 111.

Sheet discharge brush 32*a* is arranged downstream of corona charger 32.

A two-side recording operation of the image recording apparatus having the arrangement described above will be described below. Other rollers except for sheet feed roller 24 and manual feed roller 22, that is, convey roller 28, exhaust roller 44, convey roller 38, and heat roller 40 of fixing unit 3 are rotated at a predetermined convey speed of, e.g., 90 mm/sec, upon starting of a recording operation. When the recording operation is started, sheet feed roller 24 is rotated by a driving signal based on a detection signal from a seam sensor (not shown) for detecting the joint portion of image carrier belt 50. Sheets 9 are fed from tray 11 to the transfer unit one by one. The leading end of each sheet passes along sheet path 64 and causes registration sensor 26 to swing. As a result, arm 96 (FIG. 10) arranged outside sheet convey unit 5 is pivoted counterclockwise. The lower end of arm 96 is retracted from photointerrupter 98. Photointerrupter 98 generates a sheet detection signal. In response to this signal, solenoid 108 shown in FIG. 8 is energized at a predetermined timing. Operation element 106 is pivoted counterclockwise (FIG. 8) against the biasing force of spring 109. One end portion of operating element 106 abuts against pin 103*a* of arm 103 and urges it. Arm 103 is pivoted clockwise about shaft 27*a*. Upon this pivotal movement, gate plate 27 extends into the sheet convey path to prevent sheet traveling so as to perform sheet registration, as shown in FIG. 9. Rotation of sheet feed roller 24 is stopped by the sheet detection signal described above, and the sheet is stopped such that its leading end abuts against gate plate 27. When a predetermined period of time has elapsed, solenoid 108 is deenergized. Operation element 106 is pivoted in a direction of an arrow by a biasing force of spring 109 until operation element 106 abuts against stopper 110. Therefore, gate plate 27 is retracted from the sheet convey path. When gate plate 27 is retracted, the leading end of the registered sheet is inserted between feed roller 28 and pinch roller 28 by a reaction force of flexure of the registered sheet. As a result, the sheet is conveyed by rollers 28 and 29 toward corona charger 32 of the transfer unit in synchronism with a toner image formed on the image carrier belt. In this embodiment, a driving force of motor 7 is transmitted to convey roller 28 as follows. Gear train 75 connected to motor 7 is disposed near bearing 111 and pivoted about one point in FIG. 9 to mesh with gear 116 coaxial with convey roller 28 when bearing 111 is inserted into bearing groove 111.

Sheet 9 having the lower surface to which a toner image is transferred by the transfer unit is subjected to image fixing in fixing unit 3. Sheet 9 is conveyed by exhaust roller 44 through the discharge brush and the vacuum duct and is directed upward along gate 46 switched to the position indicated by the solid line. Sheet 9 is then conveyed toward convey roller 38 through reversing sheet path 69 and two-side recording sheet path 68. Sheet 9 is conveyed by convey roller 38 toward manual feed roller 22 through sheet path 67. Before sheet 9 reaches manual feed roller 22, sheet 8 abuts against sensor 36 which is then laid forward. Arm 52 (FIG. 10) located outside sheet convey unit 5 is pivoted counterclockwise (direction indicated by the solid line). As a result, arm 92 is removed from photointerrupter 94, and photointerrupter 94 generates a detection signal. When the sheet passes through the sensor 36, arm 92 is pivoted clockwise (direction of an arrow indicated by the broken line) by its own weight and abuts against pin 53.

In this embodiment, after an image is transferred to one surface of first sheet 9 and is fixed, second sheet 9 is fed from tray 11 toward the transfer unit in synchronism with a detection signal from the seam sensor. Transfer and fixing operations of the image on the second sheet are performed in the same manner as those in the first sheet.

When first sheet 9 reaches near manual feed roller 22, manual feed roller 22 is rotated at a predetermined high speed of, e.g., 360 mm/sec on the basis of the detection signal from the seam sensor in a direction opposite to that in manual feeding. When the leading end of the first sheet reaches manual feed roller 22, the sheet is abruptly conveyed into manual feed sheet path 63. When the trailing end of the sheet is detected by sensor 36 located in the sheet path 67 and a predetermined period of time has elapsed, rotation of manual feed roller 22 is stopped. At this time, manual sheet feed unit 14 serves as a two-side image recording intermediate tray. The sheet conveyed in manual paper feed unit 14 is temporarily held. By observing the sheet held in feed unit 14, an image forming state of the sheet can be checked.

Forward rotation of manual feed roller 22 at a speed of, e.g., 180 mm/sec is started in synchronism with a detection signal from the seam sensor. The sheet is conveyed in manual insertion sheet path 63. The convey direction of first sheet 9, the trailing end of which is clamped between manual feed roller 22 and pinch roller 23, is reversed, and sheet is then conveyed toward convey roller 28 through sheet path 65 again. Similarly, transfer and fixing of the toner image are performed on the lower surface of the sheet in the same operations as described above. The sheet is guided along exhaust sheet path 72 through gate 46 switched to the position of the alternate long and short dashed line. The sheet is then exhausted on exhaust tray 49 outside the apparatus through exhaust sheet path 72.

When manual sheet feed unit 14 is used as an intermediate tray having a sheet convey direction reversing function, the convey speed of manual feed roller 22 is higher than other convey rollers and the like due to the following reason. The first sheet is immediately reversed to record a toner image on the lower surface so as not to interfere conveyance of the second sheet. When manual feed roller 22 is used for manual sheet feeding which is the original function of roller 22, the convey speed of manual feed roller 22 can be equal to those of other convey rollers. Convey roller 38 is arranged to be driven through a one-way clutch so as not to interfere conveyance of manual feed roller 22 driven at a high convey speed.

Opening/closing of cover plate 48 will be described below.

FIG. 8 shows a state wherein cover plate 48 is open.

Figure 11:
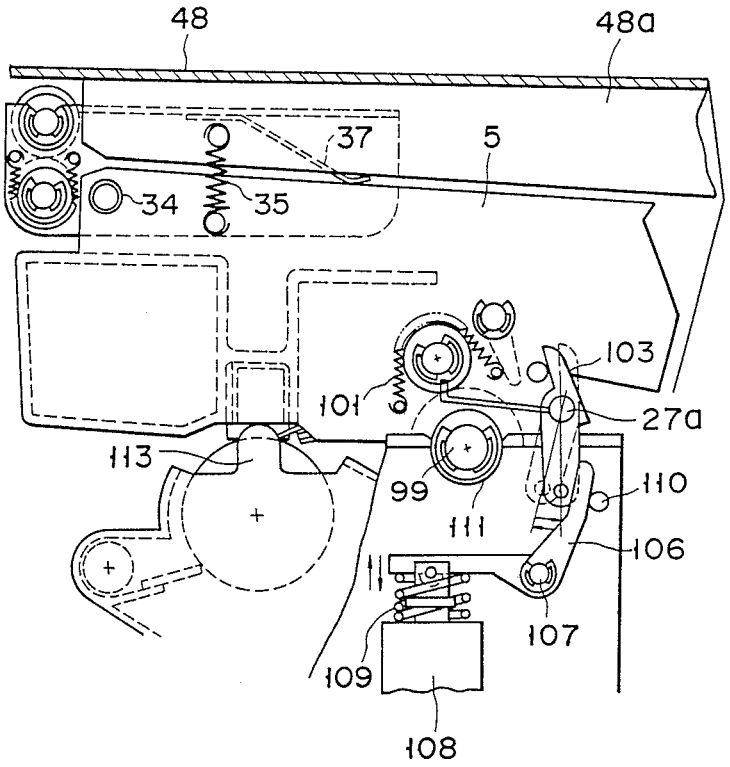

Sheet convey unit 5 is engaged with pivot shaft 34 with clearance and is held by cover plate 48 in a balanced state by spring 35, leaf spring 37, and its own weight. When cover plate 48 is gradually closed, bearing 99 extending outside sheet convey unit 5 is fitted in the bearing groove of the main body frame. When cover plate 48 is further closed, positioning member 113 located on the side plate of belt unit 2 abuts against the side plate of sheet convey unit 5. When cover plate 48 is completely closed, a sheet convey path separated by a distance of l is held to be separated by an optimal distance by sheet convey unit 5 and cover plate 48, as shown in FIG. 11. At this time, since bearing 99 is positioned by bearing groove 111 and the vertical position of sheet convey unit 5 is determined by positioning member 113 which is held by leaf spring 73, the relationship between the surface of image carrier belt 50 in the transfer unit and the position of corona charger 32 of the transfer unit, which relationship is very important for image formation, can be accurately determined.

Elimination of paper jamming will be described below. Upper surface cover 48 for causing pivot shaft 34 and suspending spring 35 to support sheet convey unit 5 located above belt unit 2 is pivoted upward through pivot shaft 47, so that sheet paths 63, 64, 65, 66, and 70 are open.

Paper jamming occurring along these paths can be easily eliminated. Sheet path 67 as part of the two-side recording sheet path can be easily open upon pivotal movement of sheet convey unit 5 about pivot shaft 34 against spring 35 in a direction of arrow E. Paper jamming occurring along sheet path 67 can also be easily eliminated.

Figure 12:
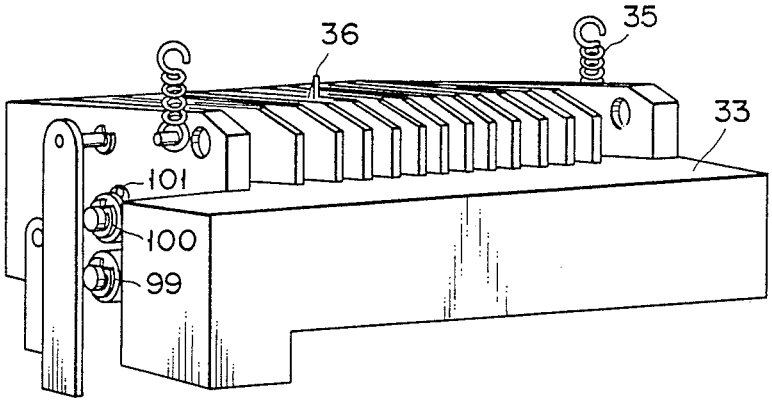
Figure 13:
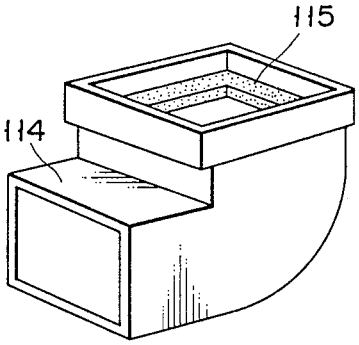
Figure 14:
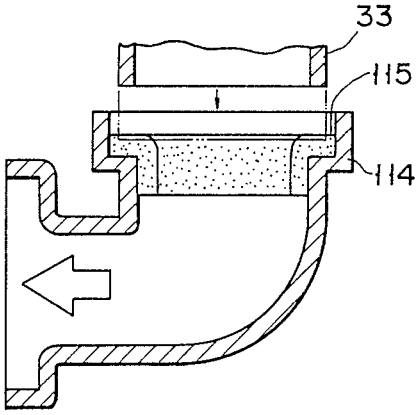

Vacuum duct 33 will be described with reference to FIGS. 12 to 14.

In this embodiment, when cover plate 48 is open, intermediate duct 114 arranged in the main body frame and connected to the vacuum pump is disconnected from vacuum duct 33 formed in sheet convey unit 5. When cover plate 48 is closed, intermediate duct 114 is connected to vacuum duct 33, so that air leakage is prevented at the connecting portion therebetween. That is, a step is formed in a coupling portion of intermediate duct 114, and elastic member 115 is attached to the coupling portion. Since vacuum duct 33 is connected to intermediate duct 114 so as to expand elastic member 115, air leakage at the connecting portion can be prevented, and the resistance of the sealing member upon coupling can be kept low.

In the above embodiment, the manual sheet feed unit also serving as an intermediate tray having the sheet convey direction reversing function is mounted on the sheet support table and sheet feed unit. However, the position of the manual sheet feed unit is not limited to the above-mentioned position, but can be arbitrarily determined at another proper position in the main body. In this case, the manual sheet feed unit can also serve as the intermediate tray, thereby obtaining the same effect as in the above embodiment.

As an image forming means, instead of the aforementioned photosensitive means using toners, other means such as an ink-jet recording head and a thermal transfer recording head may be used. In such cases, of course, the claimed "cooperating means" would not be a corona transfer unit 32, but would be another suitable unit, as is well known.

The scope of the present invention is not limited to the aforementioned embodiment, and may include various other modifications may be made by those skilled in the art without departing from the spirit and scope of the invention as set forth in the specification.

According to the present invention as has been described in detail with reference to the preferred embodiment, the means for conveying the sheet having an image formed by the image forming means is conveyed into the manual sheet feed means, and the manual sheet feed means has a sheet convey direction reversing function. Therefore, the manual sheet feed means can also serve as the intermediate tray. An exclusive intermediate tray need not be arranged, and its mounting space can be omitted. Therefore, the image forming apparatus can be simplified and made compact.

What is claimed is:

1. A two-side recording apparatus, comprising:

a main body frame having an access opening;

recording means and fixing means both provided in said main body frame;

a moveable frame means pivotally supported by said main body frame for opening and closing said access opening;

cooperating means, provided in said movable frame means, for cooperating with said recording means to define a recording section between said cooperating means and said recording means, to record an image on a surface of a sheet;

sheet feed means for feeding a sheet to said recording section;

exhausting means for removing discharging said sheet from said recording section;

first guide path means for guiding a sheet, said first guide path means extending to said exhausting means from said sheet feed means through both said recording section and said fixing means;

reversing means for reversing said surface of said sheet; and second guide path means for guiding said sheet, one surface of which has been recorded with an image by said recording means and said sheet having been reversed by said reversing means, to said recording section, said second guide path means having a portion thereof positioned over said fixing means;

a part of said second guide path means and of said recording section being arranged so as to both be exposed for access by a user when said movable frame means is pivoted to open said access opening of said main body frame.

2. An apparatus according to claim 1, wherein:

said recording means comprises a recording unit for carrying a toner image; and said cooperating means comprises a transfer unit for transferring the toner image onto said sheet.

3. An apparatus according to claim 1, wherein said reversing means comprises exhaust and pinch rollers and gate means which are located between said fixing means and said exhausting means for selectively feeding said sheet to said exhausting means and along the said second guide path means.

4. An apparatus according to claim 1, further comprising first conveying means, for conveying said sheet from said first feed means to said recording section, said first conveying means comprising:

a convey roller and a pinch roller which are located in said first guide path means near said recording section; and convey roller driving means for conveying a sheet clamped between said convey roller and said pinch roller to said recording section.

5. An apparatus according to claim 1, wherein:

said second guide path means comprises a manual sheet feed unit; and said reversing means comprises a manual feed roller and a pinch roller which oppose said second guide path means, and roller driving means for selectively rotating said manual feed roller in one and another directions for selectively feeding a sheet clamped between said pinch roller and said manual feed roller in said one direction or in said another direction, said roller driving means rotating said manual feed roller in said one direction when said sheet is fed from said recording section to said manual feed unit, and rotating said manual feed roller in said another direction when said sheet is fed from said manual feed unit to said first guide path means.

6. A two-side recording apparatus, comprising:

a main body frame having an opening;

recording means and fixing means both provided in said main body frame;

a moveable frame means pivotally supported by said main body frame for opening and closing said opening;

cooperating means, provided in said movable frame means, for cooperating with said recording means to define a recording section between said cooperating means and said recording means, to record an image on a surface of a sheet;

sheet feed means for feeding said sheet to said recording section;

exhausting means for exhausting said sheet from said recording section;

first guide path means for guiding a sheet, and extending to said discharge means from said sheet feed means through both said recording section and said fixing means;

reversing means for reversing the surface of said sheet; and second guide path means for guiding said sheet, one surface of which has been recorded with an image by said recording means and said sheet having been reversed by said reversing means, to said recording section, a portion of said second guide path means being positioned over said fixing means;

said second guide path means including a manual sheet feed unit; and said reversing means including a manual feed roller and a pinch roller which oppose said second guide path means, and roller driving means for selectively rotating said manual feed roller in one and another directions for selectively feeding a sheet clamped between said pinch roller and said manual feed roller in said one direction or in said another direction, said roller driving means rotating said manual feed roller in said one direction when said sheet is fed from said recording section to said manual feed unit, and rotating said manual feed roller in said another direction when said sheet is fed from said manual feed unit to said first guide path means.

7. An apparatus according to claim 6, wherein said manual feed roller is rotatably mounted in said main body frame, and said pinch roller is rotatably mounted in said movable frame means and is separated from said manual feed roller when said movable frame means is pivoted for opening said opening of said main body.

8. An apparatus according to claim 6, wherein said roller driving means drives said manual feed roller at a slower speed upon feeding of said sheet from said manual feed unit than the speed at which it drives said manual feed roller upon reversing of said sheet fed through said second guide path means when said manual feed roller is rotated in said another direction.

9. An apparatus according to claim 6, wherein said roller driving means drives said manual feed roller at a higher speed upon rotation in said one direction than upon rotation in said another direction, where said sheet fed from said second guide path means is reversed.

10. A two-side recording apparatus, comprising:

a main body frame having an opening;

recording means and fixing means provided in said main body frame;

a movable frame means pivotally supported by said main body frame for opening and closing said opening;

cooperating means, provided in said movable frame means, for cooperating with said recording means to define a recording section between said cooperating means and said recording means, to record an image on a surface of a sheet;

said feed means for feeding said sheet to said recording section;

exhausting means for exhausting said sheet;

first guide path means for guiding a sheet, and extending to said exhausting means from said sheet feed means through both said recording section and said fixing means;

reversing means for reversing said surface of said sheet;

second guide path means for guiding said sheet, one surface of which has been recorded with an image by said recording means and said sheet having been reversed by said reversing means, to said recording section; and conveying means for conveying said sheet to said recording section along said first guide path, said conveying means including a pair of convey rollers, and driving means coupled to said convey rollers for driving said convey rollers, said convey rollers being rotatably provided on said movable frame means, and said convey rollers being disconnected from said driving means when said movable frame means is pivoted to open said opening of said main body frame.

11. An apparatus according to claim 10, further comprising registering means, providing on said movable frame means and arranged near said convey rollers for temporarily stopping said sheet in front of said convey rollers.

12. An apparatus according to claim 10, wherein:

said main body frame includes a first position determining member; and said conveying means includes a second position determining member which is engaged with said first position determining member when said movable frame means closes said opening of said main body frame.

13. A two-side recording apparatus, comprising:

a main body frame having an opening;

recording means and fixing means both provided in said main body frame;

a movable frame means pivotally supported by said main body frame for opening and closing said opening;

a sheet convey unit supported by said movable frame means;

cooperating means, provided in said movable frame means, for cooperating with said recording means to define a recording section between said cooperating means and said recording means, to record an image on a surface of a sheet;

said feed means for feeding said sheet to said recording section;

exhausting means for exhausting said sheet;

first guide path means for guiding a sheet, and extending to said exhausting means from said sheet feed means through said recording section;

reversing means for reversing the surface of said sheet;

second guide path for guiding said sheet, one surface of which has been recorded with an image by said recording means and said sheet having been reversed by said reversing means, to said recording section; and supporting means for movably supporting said sheet convey unit on said movable frame means, said sheet convey unit and said movable frame means defining a part of said sheet guide path means therebetween; and means for biasing said sheet convey unit for broadening said part of said second guide path means.

14. An apparatus according to claim 13, wherein:

said main body frame includes a first position determining member; and said conveying means includes a second position determining member which is engaged with said first position determining member when said movable frame means closes said opening of said main body frame.

15. An apparatus according to claim 6, further comprising registering means, provided on said movable frame means and arranged near said convey rollers for temporarily stopping said sheet in front of said convey rollers.

* * * * *